United States Patent [19]

Wetzel

[11] Patent Number: 4,519,301

[45] Date of Patent: May 28, 1985

[54] AIR FLOW BALANCING FIRE DAMPER

[76] Inventor: Lawrence E. Wetzel, 3590 Watervale Rd., Manlius, N.Y. 13104

[21] Appl. No.: 570,090

[22] Filed: Jan. 12, 1984

[51] Int. Cl.[3] ..... E05F 15/20

[52] U.S. Cl. ..... 98/1; 98/86; 126/287.5; 137/75

[58] Field of Search ..... 126/287.5, 285 R, 292, 126/293; 137/72, 73, 74, 75; 98/86, 1; 169/57, 56

[56] References Cited

U.S. PATENT DOCUMENTS

| | | | |
|---|---|---|---|
| 3,981,317 | 9/1976 | Strulik et al. | 98/1 |
| 4,044,785 | 8/1977 | Larsen | 98/1 |
| 4,333,392 | 6/1982 | Nailor et al. | 98/1 |
| 4,397,223 | 8/1983 | Maxson | 98/1 |
| 4,432,272 | 2/1984 | Van Becelaere | 98/1 |

*Primary Examiner*—James C. Yeung

*Attorney, Agent, or Firm*—Bruns and Wall

[57] ABSTRACT

This device is for balancing air flow and the dispersion of air around duct throats, and is particularly adapted for already manufactured filter modules and ceiling air conditioning diffusers, where concern for spreading fire through the openings is involved. Primarily, it consists of a core assembly for the filter module hood. The assembly includes a mounted bolt and a pair of perforate discs, which will serve as a flame barrier automatically, when fire is present, and the assembly further includes a low melting point solder for its automatic operation.

3 Claims, 4 Drawing Figures

FIG. 1
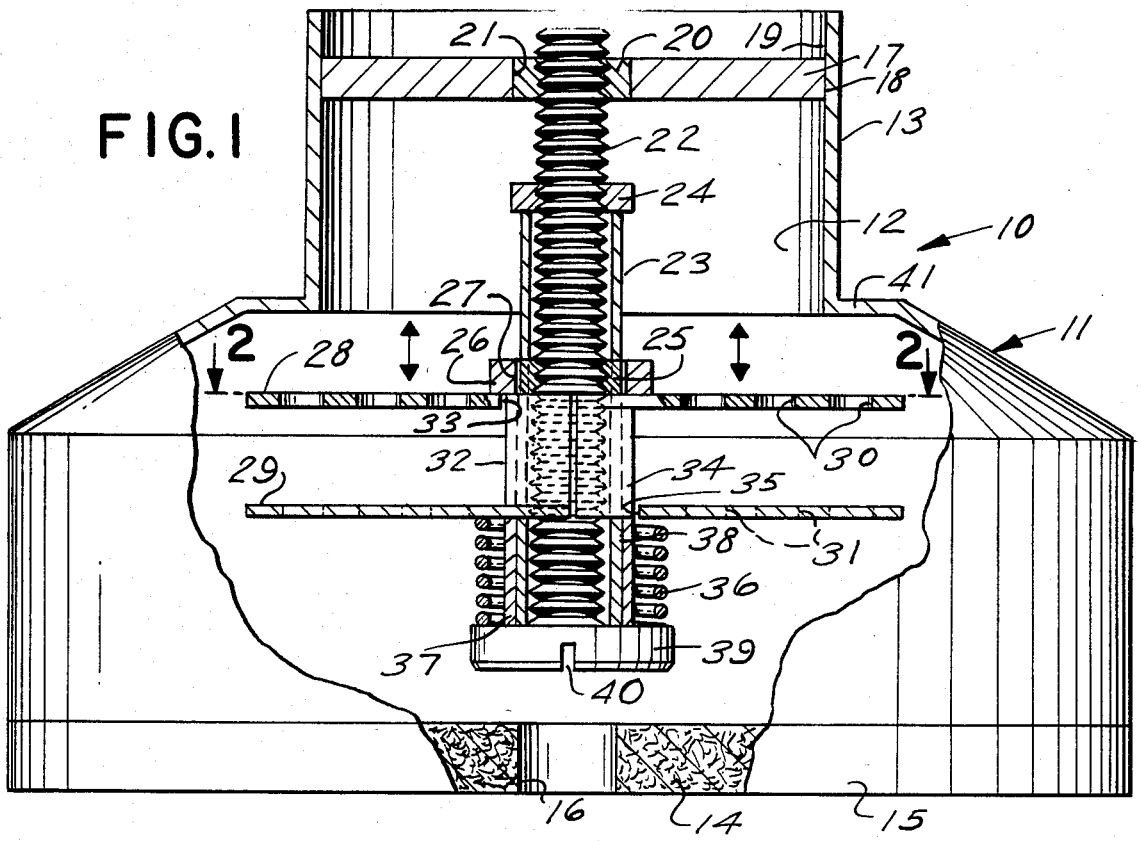
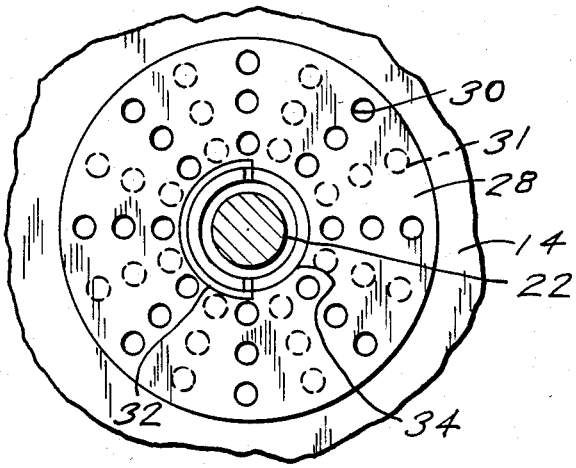
FIG. 2
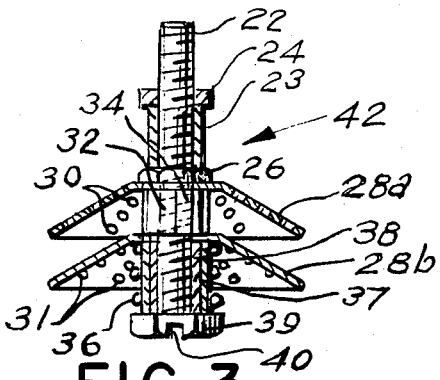
FIG. 3
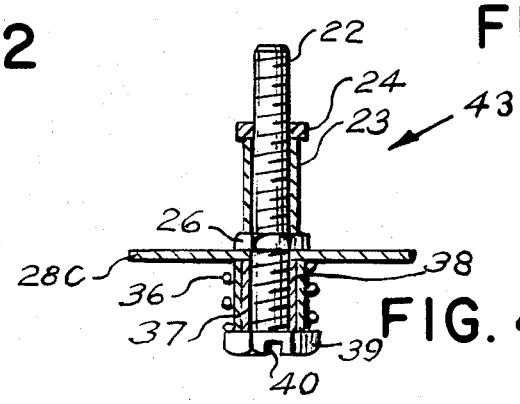
FIG. 4

AIR FLOW BALANCING FIRE DAMPER

This invention relates to fire safety dampers, and more particularly, to an air flow balancing fire damper.

The principal object of this invention is to provide an air flow balancing fire damper, which will be employed in filter modules that are well known in the art, so as to prevent fire from spreading through the opening thereof.

Another object of this invention is to provide an air flow balancing fire damper, which will be adapted to balance the air flow and dispersion of air in the round duct throats of the abovmentioned filter modules, and the design is such, that it may be employed in both new units and existing units.

Another object of this invention is to provide an air flow balancing fire damper, which will be of such design, that it will also be adaptable to ceiling air conditioning diffusers.

A further object of this invention is to provide an air flow balancing fire damper, which will use suitable soft solder means, that will melt to cause inner elements of the structure to seal, to form a barrier against flame spread, in the event of fire.

A still further object of this invention is to provide an air flow balancing fire damper, which will be easily modified to accommodate the slightly different balancing damper shaft designs that are employed by the various manufacturers of the abovementioned filter modules.

Other objects are to provide a air flow balancing fire damper which is simple in design, inexpensive to manufacture, rugged in construction, easy to use, and efficient in operation.

These, and other objects, will be readily evident, upon a study of the following specification, and the accompanying drawing, wherein:

FIG. 1 is a vertical side elevational view of the present invention, shown partly in section:

FIG. 2 is a cross-sectional view taken along the line 2—2 of FIG. 1, which is illustrated on a smaller scale:

FIG. 3 is a vertical side elevational view of a modified form of core element for FIG. 1, which is shown partially in section and on a smaller scale, and FIG. 4 is similar to FIG. 3, but illustrates another modified form of core element for use in the structure of FIG. 1.

Accordingly, a damper device 10 is shown to include a bell-shaped filter module hood 11, which is common in manufacture, having a duct throat 12 of circular configuration within its neck 13. A standard ring filter 14 is secured, in a suitable manner, within the open end of the base 15 of hood 11, as standard manufacture which includes an opening 16 in its center. A horizontal member 17 is fixedly secured, at its outer ends 18, to the inner periphery 19 of neck 13 in a suitable manner (not shown), and an internally threaded guide sleeve 20 is fixedly secured within opening 21 in a suitable manner (also not shown), which is in the center of member 17. An externally threaded shaft or rod 22 is provided, which is threadingly received within guide sleeve 20 of member 17 at one end, and a hollow sleeve 23 is freely received on shaft or rod 22. A lock nut 24 is threaded down to the top end of sleeve 23, and the bottom of sleeve 23 engages with an internally threaded sleeve 25, which is held stationary within a nut 26, by means of a low melting point soft solder 27, which is provided for a purpose which hereinafter will be described. A pair of spaced-apart discs 28 and 29 are provided, which are circular in configuration, having a plurality of openings 30 and 31 therethrough, respectively. The openings 30 of disc 28 are off-set with respect to openings 31 of disc 29, for proper dispersion of air in hood 11, and a semi-circular sleeve 34 is fixedly secured in opening 33 of disc 28, in a suitable manner, and disc 28 shall hereinafter be referred to as upper disc 28, and disc 29 shall be referred to as lower disc 29. A similar semi-circular sleeve 32 is also provided on shaft 22, and is fixedly secured within opening 35 of lower disc 29, in a suitable manner. The opposite end of sleeve 32 engages with the bottom of sleeve 25, and the opposite end of sleeve 34 engages with the top of sleeve 37, and the pair of semi-circular sleeves 32 and 34 serve to keep upper and lower discs 28 and 29 apart, by acting as spacer means, and sleeves 32 and 34, simultaneously, serve to prevent rotation of 28 and 29 with respect to each other, thus keeping their respective openings 30 and 31 off-set with each other, for controlled air flow.

Upper and lower discs 28 and 29 are urged towards each other by spring pressure means, supplied by coil spring 36, which is freely received on the outer periphery of outer sleeve 37, which is freely received on the outer periphery of inner sleeve 38 that is freely received on the shaft 22, having a nut or head 39 fixedly secured thereto. Nut 39 includes a transverse slot 40 in its outer surface, so as to receive suitably an adjustment tool for elevating and lowering discs 28, 29, to and from duct throat 12, and end wall 41 of hood 11 serves as stop means against further upward travel of upper disc 28.

In operation, nut or head 39 is used to shoulder the compression of coil spring 36, and by a tool received within slot 40 thereof, the discs 28 and 29 are elevated or lowered, simultaneously, by the rotation of shaft 22 through the rotating of 39 in guide sleeve 20, which is threaded. The raising and lowering of 28 and 29 serves to vary the air flow through the duct throat 12, and balances the flow quantity. Upon an elevated temperature, such as 165° F., depending upon setting, the solder 27 melts instantly, thus releasing the power of spring 36, which forces upper and lower discs 28 and 29 upward, until they slam against end wall 41, wherein both 28 and 29 are then in engagement with each other, and are no longer held apart by sleeves 32 and 34. The openings 30 and 31 of discs 28 and 29 now no longer afford passageway means for air flow, because 28 and 29 are a barrier to flame spread, and it shall be noted, that device 10 may be modified to include a single perforate disc, rather than 28 and 29, above-described. However, the openings will be provided near the outer peripheral edge thereof, for proper function.

Referring now to FIG. 3, a modified core assembly 42 includes all of the same components heretofore described of device 10, with the exception, that a pair of concave plates **28*a* and 28*b* are substituted for the discs 28 and 29, and each plate 28*a* and 28*b* includes spaced openings 30 and 31**, respectively.

In use, plates **28*a* and 28*b* function in the same manner as was described of the discs 28 and 29**.

Referring to FIG. 4, another modified core assembly 43 is shown to include a non-perforate disc **28*c*, which is employed in place of the above-described discs 28, 29, 28*a*, and 28*b*, and assembly 43 has the sleeves 32 and 34 removed therefrom, but includes all of the other described components. The assembly 43 further differs, in that the coil spring 36 urges, at one end, against the single disc 28***c*, and urges, at its opposite end, against head 39 of bolt or shaft 22. In the above-described structure, disc 28*c* includes no perforate openings, because 28*c* serves both as an air flow control and a flame barrier without openings.

In use, assembly 43 functions in similar fashion as was heretofore described of FIGS. 1, 2, and 3, with the exception, that the non-perforate single disc 28*c* is employed for air dispersion, which occurs around its outer peripheral edge only, and disc 28*c* serves as a flame barrier by spring 36 slamming it against end wall 41 of hood 11, to prevent air flow when the heat is sufficient to melt the solder sleeve core of nut 26.

It shall also be noted, that the filters 14 are fabricated of fiberglass, and will not support combustion. However, the dust they collect can feed a fire, and enable it to burn up in the ductwork or plenum.

While various changes may be made in the detail construction, it is understood that such changes will be within the spirit and scope of the present invention, as is defined by the appended claims.

What I now claim is:

1. For use with a filter module having an air flow duct, an air flow balancing fire damper having means for closing the duct if the temperature therein exceeds a predetermined limit, the closing means comprising a support member in the duct, an elongated rod in threaded engagement with the support member, the rod depending from the support member in substantially coaxial relation to the duct, a pair of circular plate members loosely mounted on the rod in coaxial relation thereto, the plate members having air passage openings therethrough, the openings in one of the respective plate members being out of axial alignment with those of the other plate member, spring means on the rod for biasing the plate members into duct closing position, and means normally holding the plate members in spaced relation to the duct and to one another, the last-named means including fusible means that permits the spring biasing means to move the plate members into duct closing position when the duct temperature exceeds the predetermined limit, the plate members at the same time coacting to shut off the plate member air passage openings.

2. A damper as defined in claim 1 wherein the means for holding the plate members in spaced relation to one another includes two half sleeves one of which is secured to each plate member, the half sleeves preventing rotation of the plate members relative to one another.

3. A damper as defined in claim 1 wherein the means for holding the plate members in spaced relation to the duct includes a sleeve threadedly engaging the elongated rod at a point spaced from the duct, and a nut element encircling the sleeve in closely spaced relation thereto, the fusible means normally occupying the space between the nut and sleeve so as to secure then together, the nut being in engagement with one of the plate members whereby it operates to releasably hold the members in spaced relation to the duct.

* * * * *